US010172766B2

(12) United States Patent
Shaanti

(10) Patent No.: US 10,172,766 B2
(45) Date of Patent: Jan. 8, 2019

(54) SOUND SOOTHER

(71) Applicant: Rohan Shaanti, Toronto (CA)

(72) Inventor: Rohan Shaanti, Toronto (CA)

( * ) Notice: Subject to any disclaimer, the term of this patent is extended or adjusted under 35 U.S.C. 154(b) by 332 days.

(21) Appl. No.: 14/809,996

(22) Filed: Jul. 27, 2015

(65) Prior Publication Data

US 2016/0022547 A1 Jan. 28, 2016

Related U.S. Application Data

(60) Provisional application No. 62/030,001, filed on Jul. 28, 2014.

(51) Int. Cl.

| | |
|---|---|
| ***A61J 17/00*** | (2006.01) |
| *G10D 7/04* | (2006.01) |
| *A61J 17/02* | (2006.01) |

(52) U.S. Cl.
CPC ..... *A61J 17/002* (2015.05); *A61J 17/001* (2015.05); *A61J 17/02* (2013.01); *G10D 7/04* (2013.01)

(58) Field of Classification Search
CPC ..... A61J 17/002; A61J 17/001; G10D 7/04
See application file for complete search history.

(56) References Cited

U.S. PATENT DOCUMENTS

| | | | | | |
|---|---|---|---|---|---|
| 904,914 | A | | 11/1908 | Anderson | |
| 2,825,335 | A | * | 3/1958 | Natonek | A61J 17/002 606/236 |
| 4,180,008 | A | * | 12/1979 | Nakamoto | G10K 1/071 116/170 |
| 4,768,510 | A | * | 9/1988 | Leung | A61J 17/002 606/234 |
| 4,856,519 | A | * | 8/1989 | Teves | A61J 17/002 606/234 |
| 5,211,656 | A | * | 5/1993 | Maddocks | A61J 17/008 606/234 |
| 5,766,223 | A | * | 6/1998 | Johnson | A61J 17/02 606/234 |

* cited by examiner

*Primary Examiner* — Richard Louis
(74) *Attorney, Agent, or Firm* — Nasser Ashgriz; UIPatent Inc.

(57) ABSTRACT

A pacifier or a teething device comprising of a mouth-guard having a body, said body having a front-surface, a back-surface, and a thickness wherein said thickness makes an interior space; a mouth-piece having a proximal end to be placed in a mouth and a distal end connected to said front-surface of said mouth-guard; an instrument embedded in said interior space or being connected to said back-surface of said mouth-guard or being connected to the front-surface of the said teething device; and a handle connected to said back-surface of said mouth-guard or connected to said instrument.

8 Claims, 20 Drawing Sheets

SOUND SOOTHER

RELATED APPLICATION

The present application claims the priority date of provisional patent application No. 62/030,001 filed Jul. 28, 2014.

FIELD OF THE INVENTION

The present invention relates to non-electronic musical instruments combined with pacifying devices and teething devices for infants and youths.

BACKGROUND OF THE INVENTION

Different types of pacifiers and teething devices are available which are used to calm and soothe an infant, but few contain non-electronic musical elements like the present invention does. Teething Ring, U.S. Pat. No. 904,914A does embody a harmonica with a teething device, but it does not embed a teething nipple, shakers, clackers bells, whistles, kazoos, ocarinas or tambourines like the present invention does.

SUMMARY OF THE INVENTION

The present invention encourages creativity among young users and is ideal for developing an early interest in music amongst users. The present invention is a pacifying device that lets a user convert the pacifier into a harmonica or shaker by changing how they handle and interact with the device.

To use as a soother or pacifier for users who are teething, or for calming a cranky infant or child who has or might not have teeth, the user places the pacifier in their mouth and chews or sucks on the nipple. To function as a harmonica, the user holds the mouthpiece to their mouth and inhales or exhales air through the mouthpieces. As the user exhales air into the mouthpiece, air-flow vibrates the blow-harmonica reeds, creating a sound. As the user inhales air through the mouthpiece of the device, the air-flow vibrates draw-harmonica reeds, creating a sound. Different size reeds create different sounds; longer reeds produce lower pitched sounds while shorter reeds produce higher pitched sounds.

To function as a shaker, the user holds the device with their hands and shakes the device. The invention can also be permanently installed or detachable; bells, tambourines, whistles, clackers, kazoos, flutes and ocarinas.

Further defined, harmonicas of the present invention comprise of small metal, plastic, wooded, or copper reeds that are mounted to a plate, or are molded within a frame or a structure. When airflow passes over said reed, in the direction of attached side to unattached side, the reed vibrates, creating a sound. Harmonica reeds can be activated by inhaling or exhaling air through the device. By inhaling air, or drawing air through the harmonica, reeds facing corresponding direction will vibrate. By exhaling air, or blowing air through the harmonica, reeds facing corresponding direction will vibrate. Harmonicas or reeds can also be activated by squeezing an air sack or containment mechanism that directs air over reeds as it is squeezed, and draws air over reeds as it refills air sack or containment mechanism.

Shakers of the present invention are a percussive musical instrument used for creating rhythm in music. The method of creating the sound involves shaking and moving the shaker element back and forth. The shaker element comprises a container, small loose objects such as beads, pebbles or beans which create the percussive sounds as they collide with each other and the container or casing.

Tambourine of the present invention comprise of small jingles consisting of multiple metallic, plastic, wooden or copper discs that makes sounds when they collide with each other. Tambourines of the present invention are made up of jingles that are loosely mounted to a pin, a string, or are unbound within the container or casing structure. When shaken, the jingles hit each other, creating a sound. Larger jingles produce lower tone notes while smaller jingles make a higher tone notes. Different jingle materials will influence the sound heard by user when shaken.

Bells of the present invention consist of small metallic balls contained within a metal sphere. When shaken, the ball hits the sphere, vibrating it and creating a musical sound. Larger metal spheres create a lower pitched sound while smaller metal spheres create a higher pitched sound. Bells can be mounted onto or inside the body of the building blocks of present invention or onto external surfaces without the support of block frame.

Clackers of the present invention are made from a series of wooden or plastic plates that are bound together on one end and open on the other end, or plates loosely mounted to a pin, or plates that are unbound within container or casing of structure. When shaken or moved, the plates hit each other, creating a sound. Larger plates make lower pitched sounds while smaller plates make higher pitched sounds.

Squeeze-reeds of the present invention allow for sound to be made by squeezing an air pouch that activates reeds as air passes over them. Sound is also made as the pouch refills with air, drawing air over reeds while it refills.

Kazoos of the present invention are a wind instrument that creates an amplified humming sound, similar to the sound. When the user hums into the mouthpieces, it vibrates a membrane which creates a sound.

Ocarina of the present invention is a wind instrument that creates a musical tone. The user blows air into the mouthpiece and covers and removes holes upon the body to change musical notes.

The present invention can be used by users of all ages but is especially designed for infants and young children. It is the primary objective of the invention to introduce musical instruments to users less than three years of age, though users of all ages can enjoy the device.

It is another objective of the present invention advance a child's musical awareness, musical communications skills, and to teach a basic understanding of musicology before they learn how to speak.

BRIEF DESCRIPTION OF THE DRAWINGS

Embodiments hereinafter will be described in conjunction with the appending drawings provided to illustrate and not to limit the scope of the claims, wherein like designations denote like elements, and in which:

DETAILED DESCRIPTION OF THE DRAWINGS

In the following description, the drawings illustrate various embodiments of the present invention. The illustrated embodiments are examples and do not limit the scope of the claims.

Teething-device, teething-nipple, chewing-device, pacifying-device or pacifying mouthpiece of the present invention, hereon referred to as pacifier, soothes or calms an infant when cranky, teething, or just passing time. Pacifiers provide relief and oral stimulation for users when feeling a comfort or discomfort in their mouth. Pacifiers found on the present invention may have many different shapes and textures, some specifically designed for users who are teething, some specifically designed for newborns, and some designed for older users.

Mouth-guard or swallow-guard, heron referred to as Guard, prevents an infant user from swallowing the device. The guard is larger than the mouth of a user, so the device cannot get caught in the user's throat. The pacifier is attached the guard by various different means. The pacifier and guard can be made as one combined unit.

Attachment mechanisms such as magnets, latches, screw on clips, Velcro, or spiral interlocking grooves, heron referred to as attachment-surface, allows teething devices and instruments of the present invention to fasten to each other.

Instruments embedded handgrips and holding devices such as handles as well as attachment-surfaces, hereon referred to as Instrument-handle, provides an extra holding handle for instruments and teething devices of the present invention. Instrument-handle mounts to other devices of the present invention using corresponding attachment-surfaces.

Figure 1:
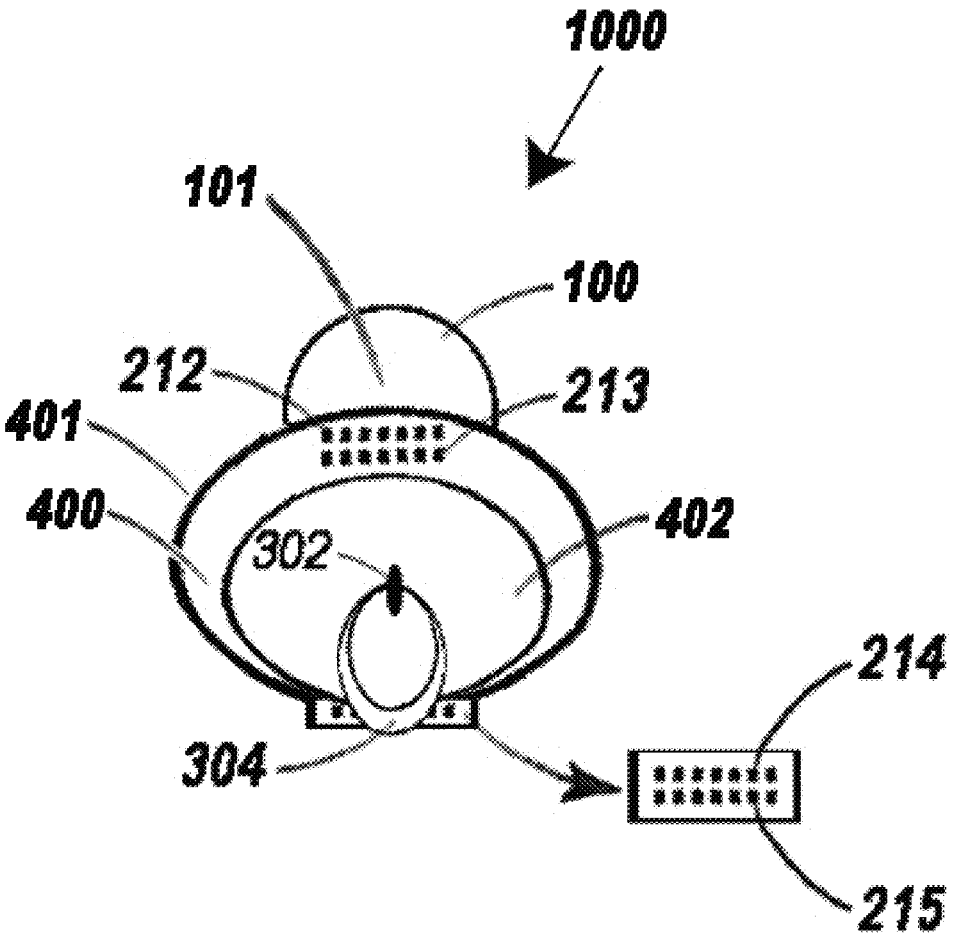
FIG. 1 illustrates the present invention embedded a teething device, a harmonica, and a handle.

As shown in FIG. 1, a pacifier or a teething device 1000 comprises of a mouth-guard 400 having a front-surface 401, a back-surface 402, said front-surface 401 and back-surface 402 enclosing an interior volume; a mouth piece 100 having a proximal end (nipple) 100 to be placed in a mouth and a distal end 101 being connected to said front-surface 401 of said mouth-guard; said mouth-guard 400 having at least a wind instrument 212-215 embedded in its structure; said wind instrument being selected from the group consisting of a harmonica, a whistle, a kazoo, and an ocarina, and a handle 304 being connected to said back-surface 402 of said mouth-guard 400.

FIG. 1 illustrates the present invention embedded a teething device 100, a harmonica 212-215, and a handle 304. A user can chew on the nipple or teething device 100 and inhale or exhale air through the harmonica mouthpieces 212-213. The mouth-guard 400 embedded a harmonica blow mouthpiece 213-214 and harmonica draw mouthpiece 212 and 215, allowing the user to make sounds by inhaling through 212 and 215 and exhaling through 213-214, making sounds as it vibrates the corresponding reeds. The user can hold the device 1000 by the mouth-guard 400 or handle 304. The handle 304 is connected to the body 300 by a connection means 302.

Figure 2:
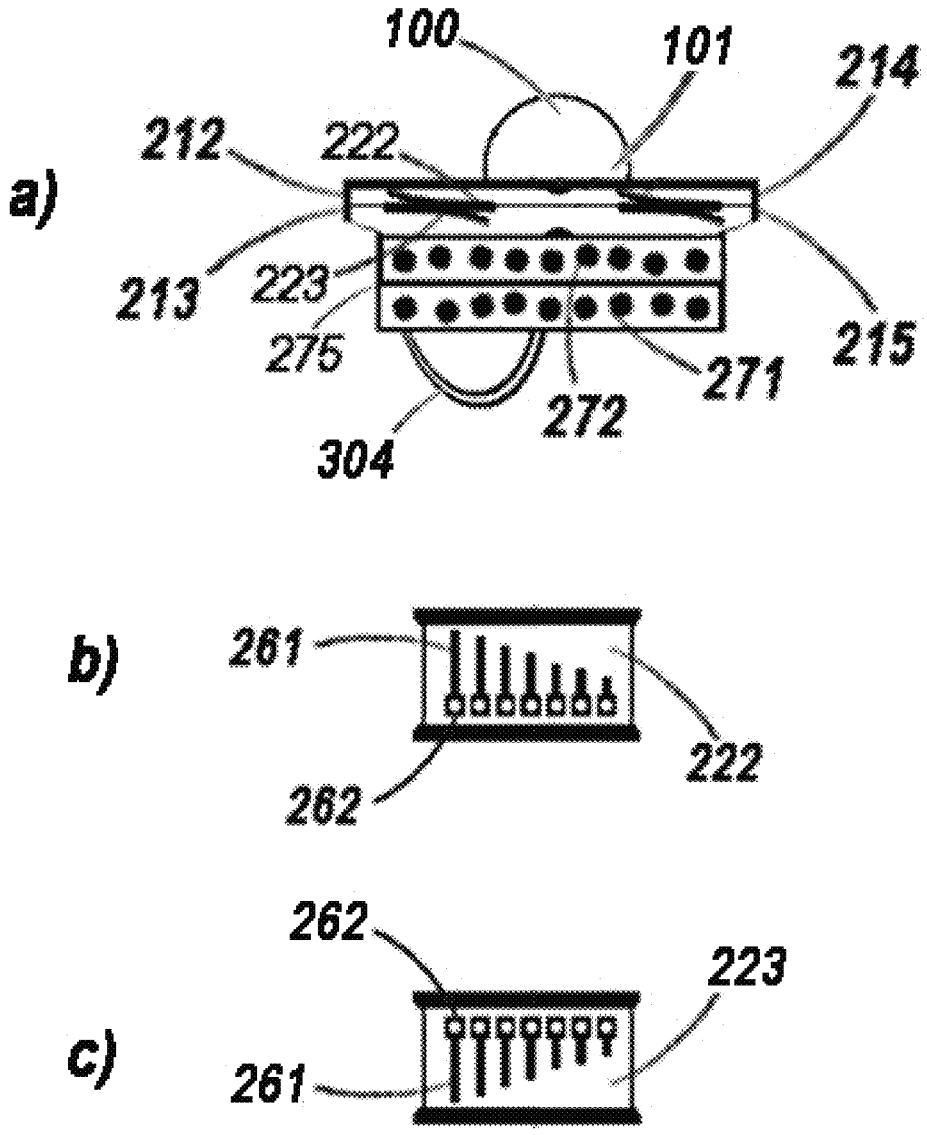
FIG. 2 (*a-c*) illustrates an exploded view of FIG. 1, showing reeds, air-chambers, shakers, and a handle.

FIG. 2 illustrates an exploded view of FIG. 1, showing two sets of reeds 222-223, air-chambers, shakers 271-272, and a handle 304; the user can inhale or exhale air through the various mouthpieces. In this example, air flow passes over two sets of reeds when any mouthpiece 212-215 is used, creating more sounds.

Again as shown in FIG. 2, reed sets 222 can make sounds when air is inhaled from mouthpiece 212, and exhaled from mouthpiece 214. Reed sets 223 make sounds when air is exhaled from mouthpiece 213 and inhaled from 215.

Reeds 261 are aligned in such a way that they make sounds when air passes over them in a particular direction. Reeds 261 are a narrow piece of metal, copper, wood, plastic, or bamboo that are arranged at such an angle that when air passes through in the appropriate direction, it vibrates the reed 261, creating a sound. Various sounding notes are achieved based on the length of the reed 261. Long reeds 261 make lower pitched sounds while shorter reeds make higher pitched sounds.

Again as shown in FIG. 2, shakers 271 and 272 are dry seeds, grains, or plastic beads within the body of the device that makes sounds when shaken. Shakers may vary in size, and sounds heard vary depending on what material is used.

Again as shown in FIG. 2, a wall or chamber or divider 275 separates the contents of two different instruments, so the sound heard is a combination of two or more shaker materials.

Figure 3:
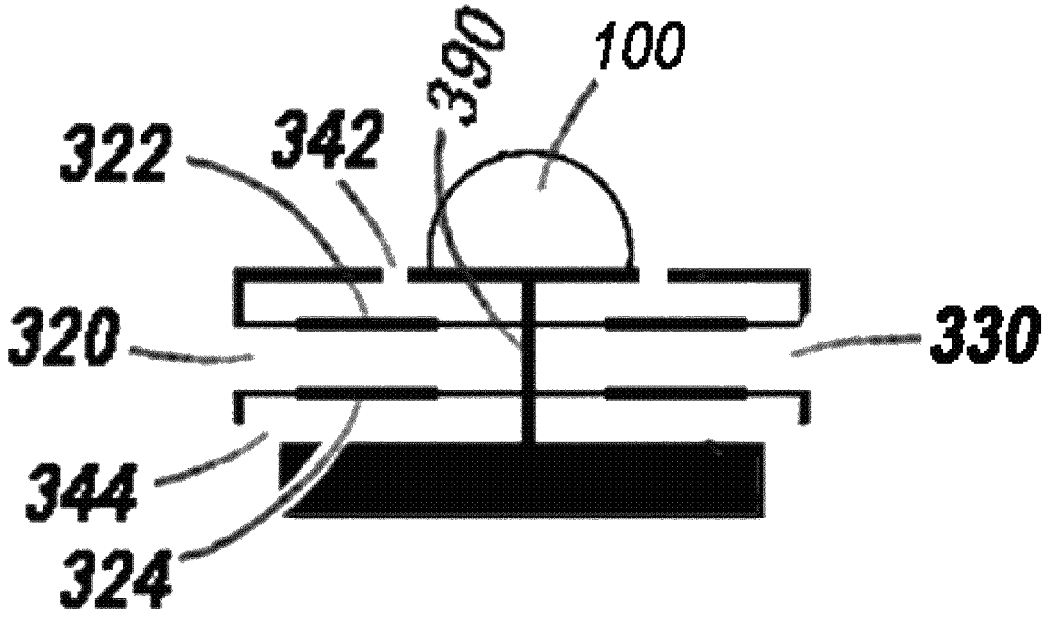
FIG. 3 illustrates the present invention embedded multiple harmonica assemblies, and reeds, which is not activated by airflow.
Figure 4:
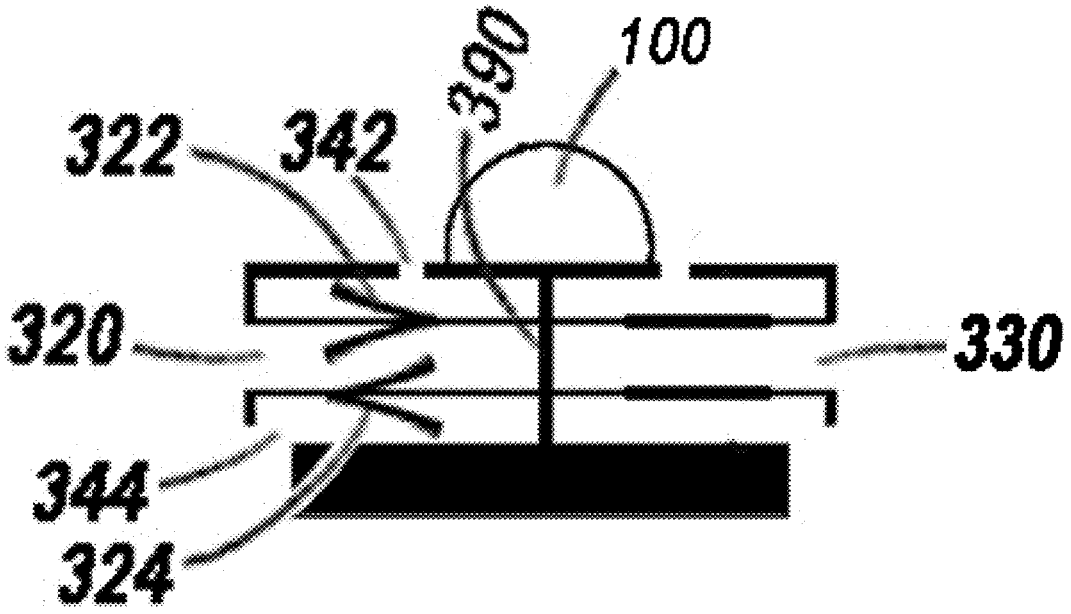
FIG. 4 illustrates the present invention embedded multiple harmonica assemblies, and reeds, which is activated by airflow.

FIGS. 3 and 4 illustrate the present invention embedded multiple harmonica assemblies, and reeds, that are not activated by airflow and activated by airflow.

As shown in FIGS. 3-4, the user can use device as a harmonica by inhaling or exhaling air through mouthpieces 320 and 330. Chamber 390 separates the airflow between 320 and 330. When the user blows air into 320, reeds 324 will vibrate as excess air exits from airflow hole 344. When the user inhales air from 320, air enters from airflow hole 342 and vibrates reeds 322.

Figure 5:
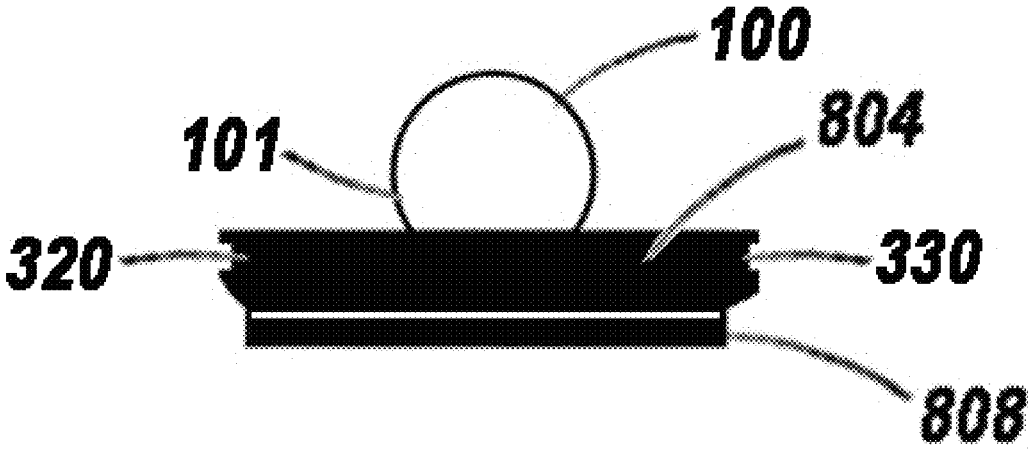
FIG. 5 illustrates the present invention embedded a teething device, multiple harmonica mouthpieces, and an attachment-surface.

FIG. 5 illustrates a side view of FIG. 3, showing nipple 100, and mouthpieces 320 and 330, as well as attachment-surface 808. Attachment-surface 808 such as magnets, latches, screw on clips, Velcro, or spiral interlocking grooves allows teething devices and instruments of the present invention to fasten to each other.

Figure 6:
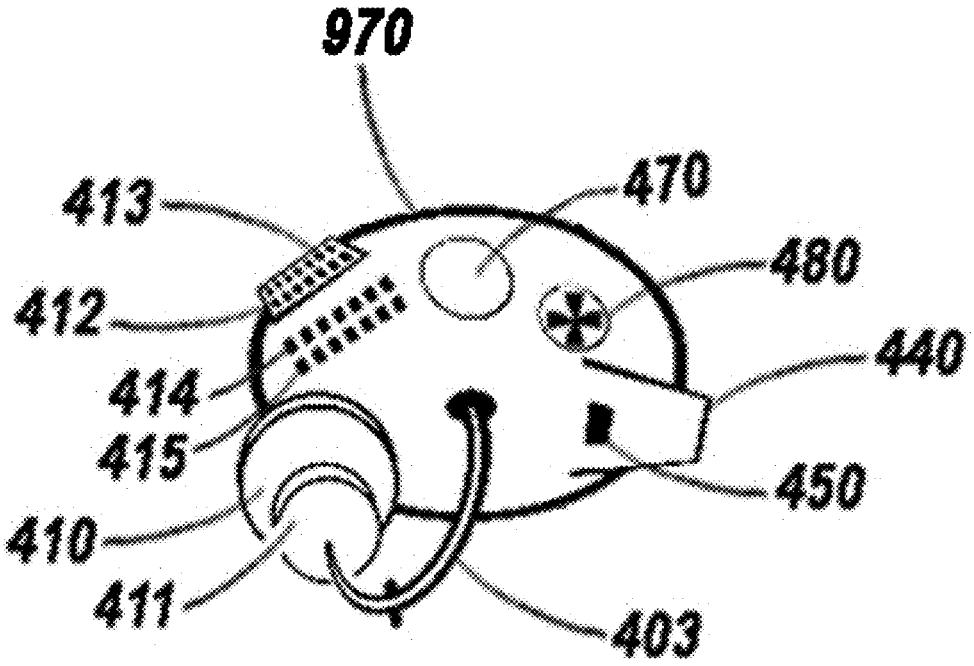
FIG. 6 illustrates an instrument-handle of the present invention embedded harmonica draw-mouthpieces and blow-mouthpieces, tambourine jingles, clackers, bells, shakers whistles, attachment-surfaces, and a handle.
Figure 7:
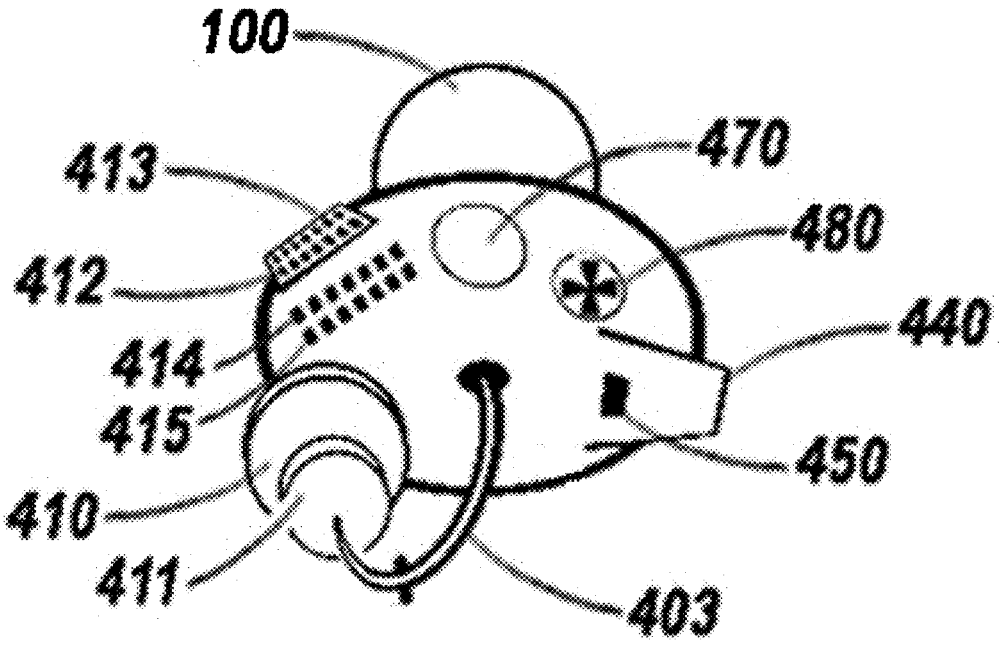
FIG. 7 illustrates a pacifier of FIG. 5 attached to instrument-handle of FIG. 6.

FIGS. 6-7 illustrate teething device and pacifier with additional instruments including tambourine jingles 410, clackers 411, bells 480, shakers 470, whistles 440 and harmonicas 412-415, as well as a handle 403.

Instrument-handle of FIGS. 6 and 7 can make sounds by shaking the device, activating the bells 480, shaker 470, tambourine jingles 410, and clackers 411. User can make sounds by blowing air into the whistle 440 or harmonica mouthpieces 412 and 413.

Figure 8:
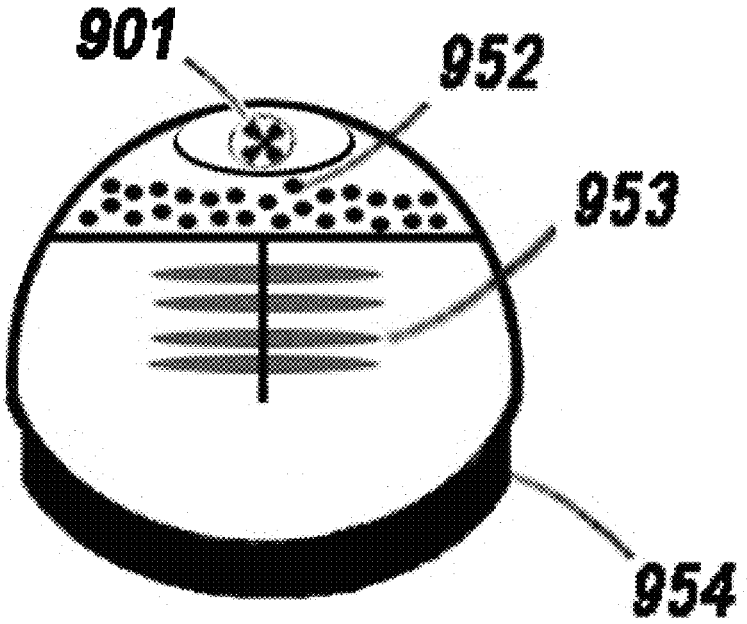
FIG. 8 illustrates an instrument attachment of the present invention that contains, bells, shakers, and tambourine jingles within a dome shaped shell and attachment-surface.

FIG. 8 illustrates an attachable musical instrument comprises of tambourines 953, bells 901 and shakers 952, with attachment-surface 954. The attachable musical instrument can attach to the present invention by its attachment-surface 954.

Instruments and attachment-surface of FIG. 8 are within a closed structure so that users cannot remove and choke on the device. The enclosed structure is larger than a child's mouth.

As shown in FIG. 5, swallow-guard 804 is a housing for the musical instruments and teething material. The swallow guard 804 is larger than a child's mouth and cannot be swallowed by a small child. The swallow-guard 804 is made of or covered with a chewable material that cannot harm a child's mouth, gums or teeth.

Figure 9:
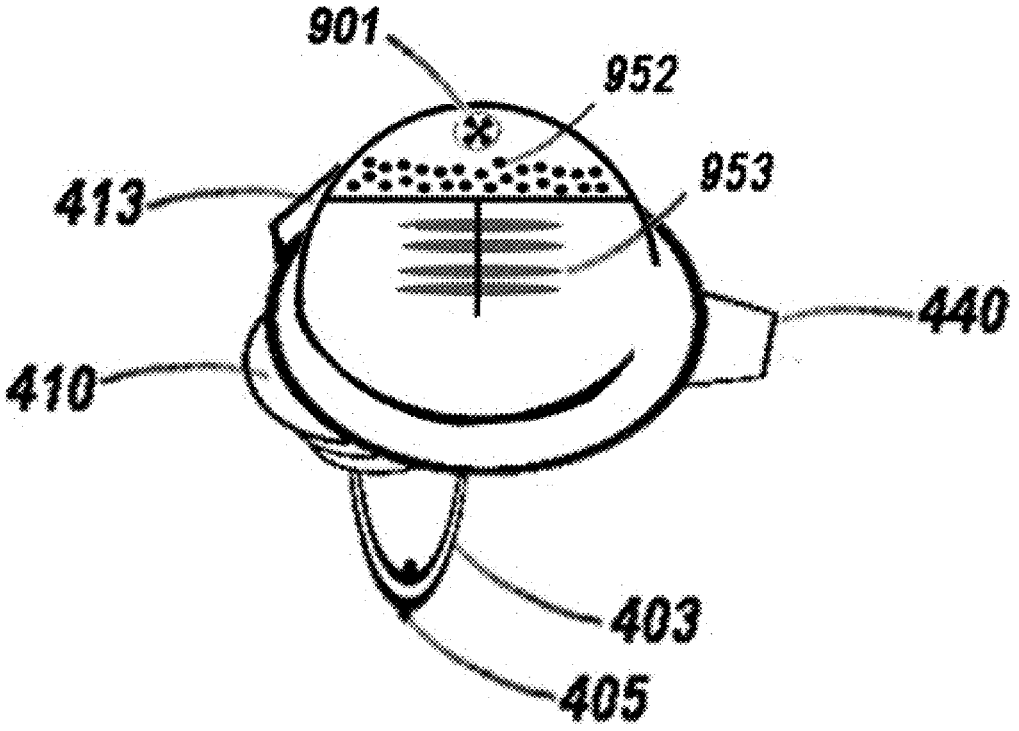
FIG. 9 illustrates instrument of FIG. 8 attached to instrument-handle of FIG. 6.

User can attach teething device of FIG. 5 to additional instruments of FIG. 6 with attachment-surface 808, as illustrated in FIG. 7. Detachable instruments of the present invention have corresponding attachment-surfaces 970. Once attached to the teething device, the user can use the teething device with additional instruments. Users may also use instrument-handle without a teething device mounted, as an instrument of its own. Users may also attach instruments of FIG. 6 to other instruments of the present invention using corresponding attachment-surfaces. FIG. 9 illustrates instrument of FIG. 8 mounted to instrument-handle of FIG. 6.

Instruments of FIG. 8 such as bells 901, shakers 952, tambourines 953, and clackers 956, can be attached to teething device of FIG. 3, or instruments of FIG. 6, or can be used independently as an instrument by shaking. Other variations of attachable instruments include kazoos, flutes, whistles, recorders, ocarinas, and squeezable reeds chambers, shown in FIGS. 10-12. Attachment-surface 954 allow for the instrument to attach to additional instruments, teething devices, or instrument-handle of FIG. 6, as shown in FIG. 9.

Figure 10:
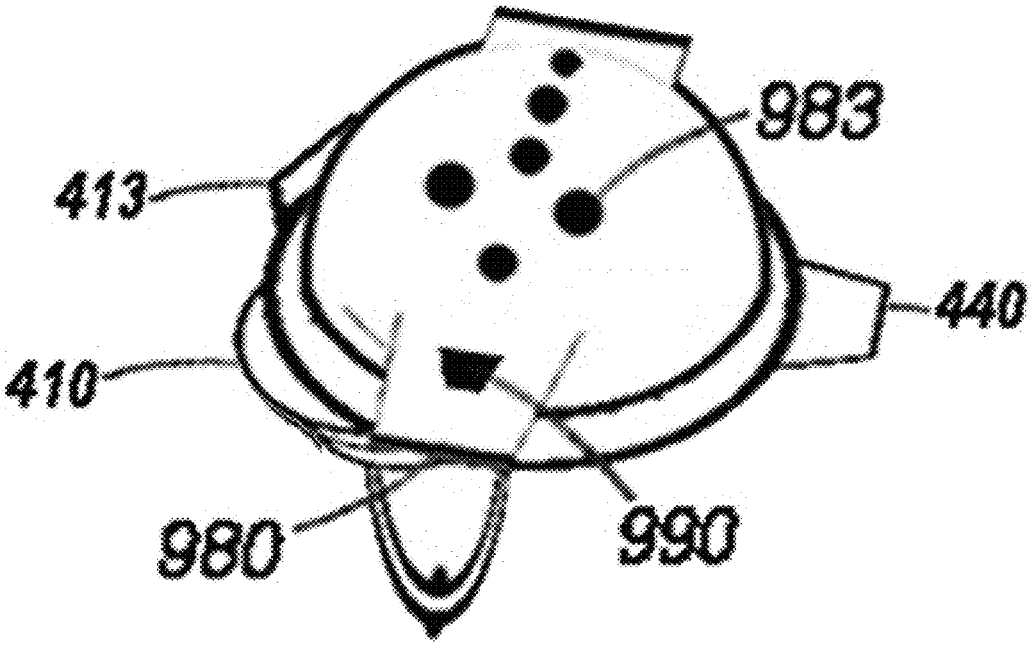
FIG. 10 illustrates an ocarina of the present invention attached to instrument-handle of FIG. 6.
Figure 11:
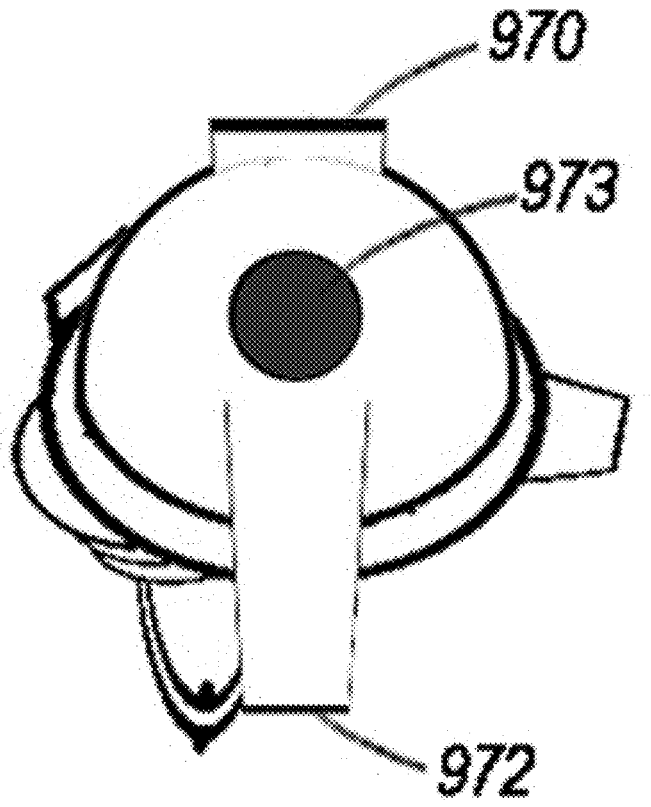
FIG. 11 illustrates a kazoo of the present invention attached to instrument-handle of FIG. 6.

FIG. 10 illustrates musical instruments such as ocarinas, recorders or flutes attached to instrument-handle of FIG. 6. and also FIG. 11 illustrates musical instruments such as kazoos attached to instrument-handle of FIG. 6.

Wind instrument such as ocarinas, flutes, whistles or recorders, hereinafter referred to as ocarinas, illustrated in FIG. 10, comprises of a mouthpiece 980, a wind cutter, lip or edge 990, and tone holes 983. As the user blows air through the mouthpiece 980, it hits the wind cutter 990 and makes a sound. As the user covers and uncovers tone holes 983 with their fingers, the sound changes.

Wind instruments such as kazoos, illustrated in FIG. 11, comprises of a mouthpiece 970 that is activated when the user hums through the mouthpiece, creating a small amount of air pressure in the cavity which activates a vibrating disc or membrane 973 that vibrates with the air and makes an amplified sound of the hum, as excess air passes through the airflow hole 972.

Figure 12:
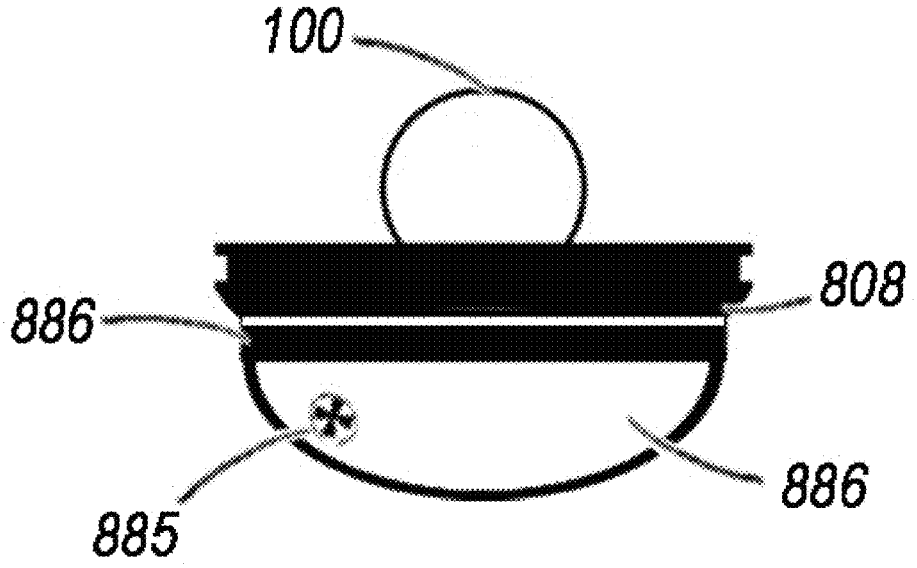
FIG. 12 illustrates squeeze-reeds of the present invention attached to pacifier of FIG. 5.

FIG. 12 illustrates a squeeze activated reed sound maker mounted with teething device of FIG. 5. User can squeeze device to create a sound. By squeezing the flexible shell 886, air escapes through hole embodying reeds 885, vibrating the air-out aligned reeds and creating a musical sound as the sound escapes. As air enters back into the device, sound again is created as air passes over the air-in aligned reeds. The squeeze activated sounds can attach to instruments or teething devices of the present invention using attachment-surfaces 886.

Figure 13:
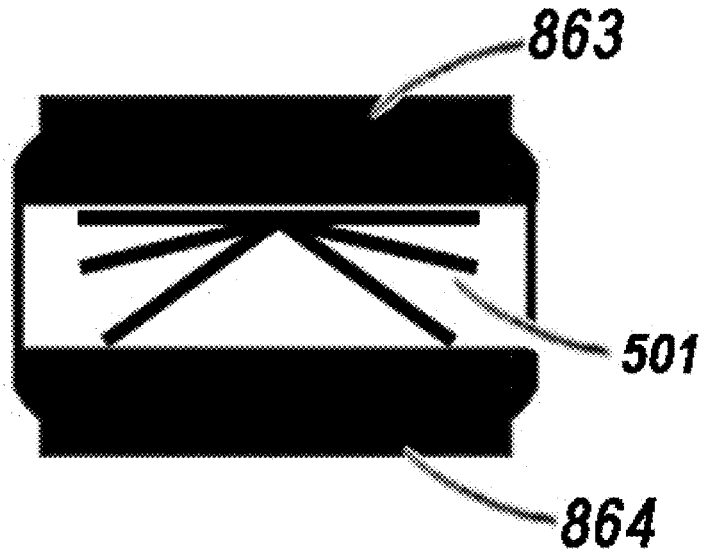
FIG. 13 illustrates clackers of the present invention with attachment-surfaces.
Figure 14:
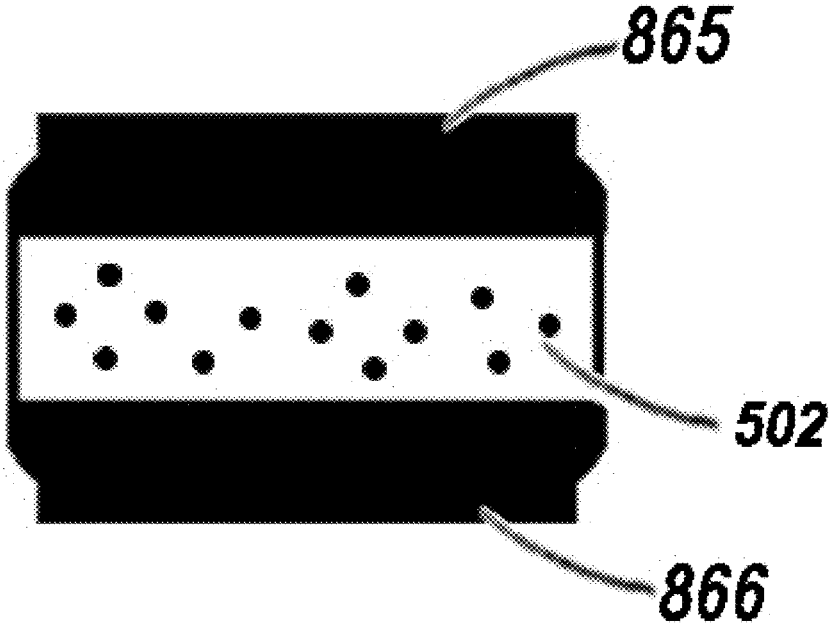
FIG. 14 illustrates shakers of the present invention with attachment-surfaces.

FIG. 13 illustrates a clacker 501 instrument of the present invention, with attachment-surfaces 863 and 864. FIG. 14 illustrates a shaker instrument 502 of the present invention, with attachment-surfaces 865 and 866.

Figure 15:
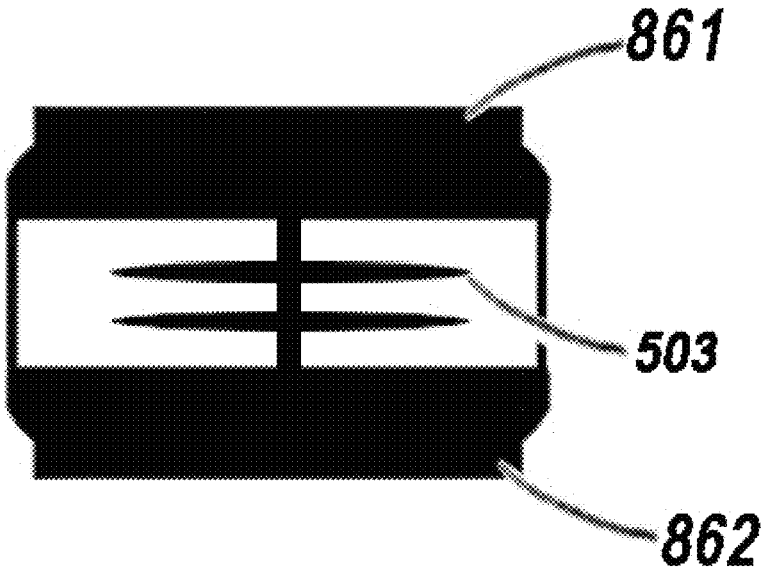
FIG. 15 illustrates tambourines of the present invention with attachment-surfaces.
Figure 16:
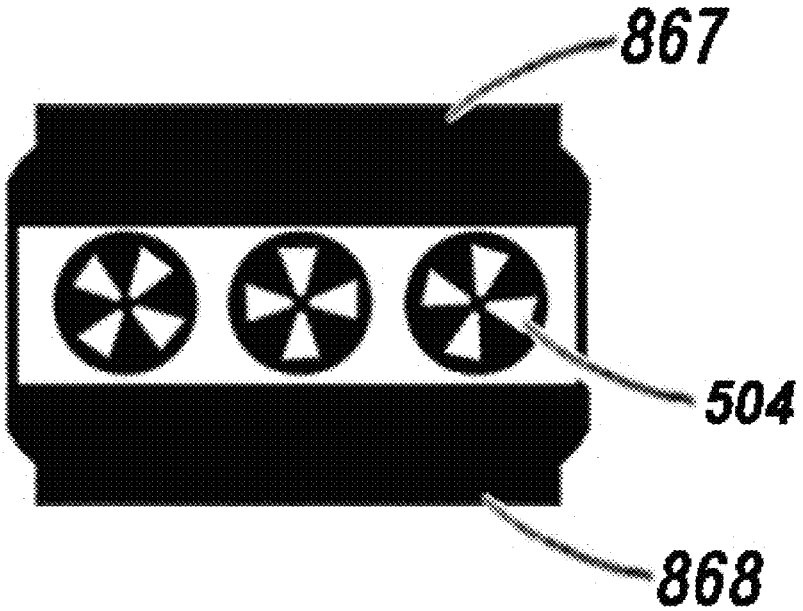
FIG. 16 illustrates bells of the present invention with attachment-surfaces.

FIG. 15 illustrates a tambourine instrument 503 of the present invention, with attachment-surfaces 861 and 862. FIG. 16 illustrates bell instrument 504 of the present invention, with attachment-surfaces 867 and 868.

Figure 17:
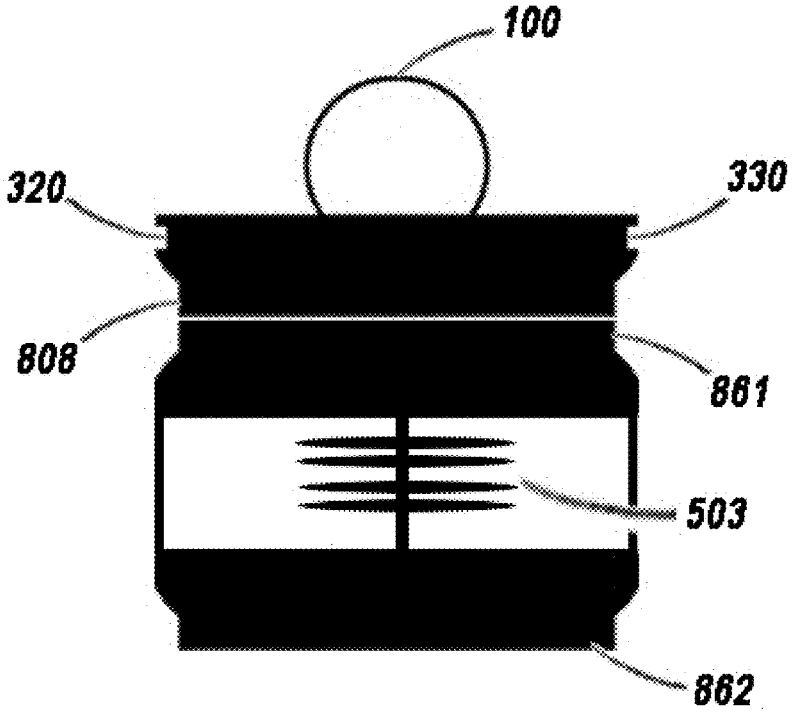
FIG. 17 illustrates pacifier of FIG. 5 attached to tambourines of FIG. 15.

Instruments of FIGS. 13-16 can attach to harmonica or teething device of the present invention, as illustrated in FIG. 17 where teething device of FIG. 5 and tambourine jingles of FIG. 15 are attached to each other by attachment-surfaces 808 and 861.

Figure 18:
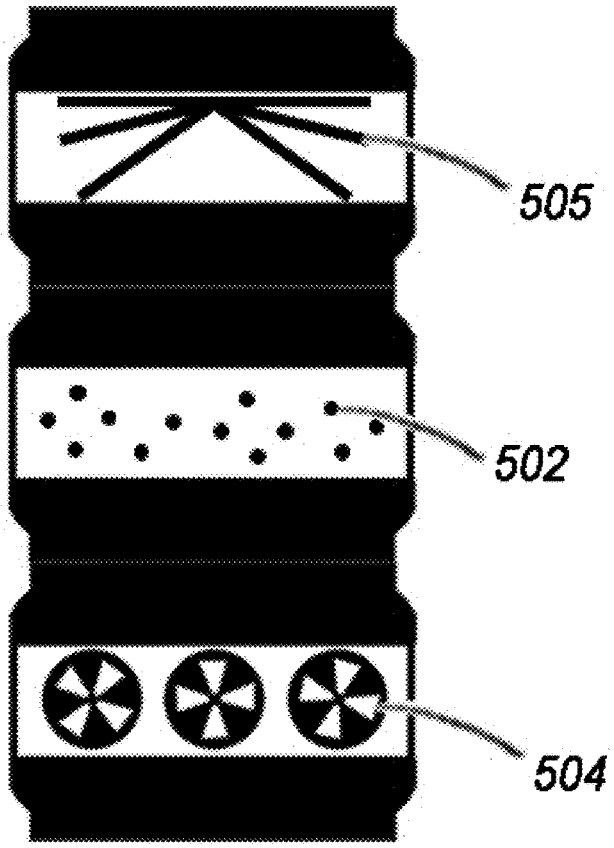
FIG. 18 illustrates instruments of FIG. 13, FIG. 14, and FIG. 16 attached to each other's.

Instruments of FIG. 13-16 can all attach to each other in many different combinations using attachment-surfaces. User can mix and match sounds by attaching one attachment mechanism to another. Instruments of FIG. 13-16 all make sounds by shaking. By combining different instruments with each other, the user effectively creates combinations of sounds, which act as one instrument when shaken together. FIG. 18 illustrates instruments of FIG. 13, FIG. 14 and FIG. 16 attached together, creating one instrument with a combination of sounds.

Instruments of FIGS. 13-16 are contained in a casing that will not harm a child if they chew on instrument. Instruments of FIGS. 13-16 also function as teething devices.

Figure 19:
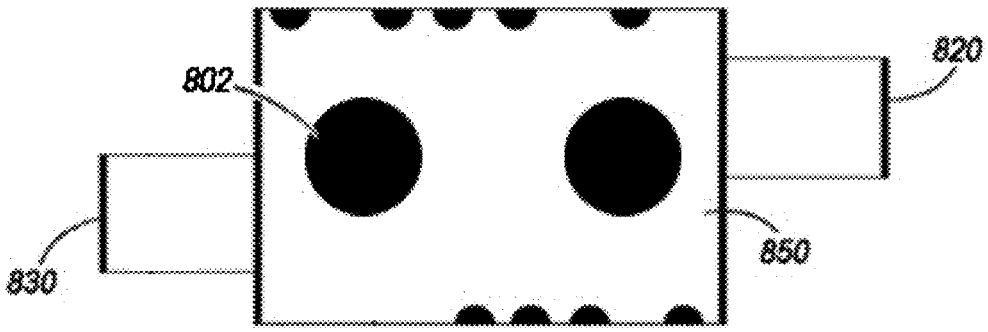
FIG. 19 illustrates teething device of the present invention embedded two mouthpieces, air-flow holes, and attachment-surfaces.

FIG. 19 illustrates an example of the present invention embedded two mouthpieces or teething devices 820 and 830, and outer shell or protective casing 850, and attachment-surfaces 802.

Figure 20:
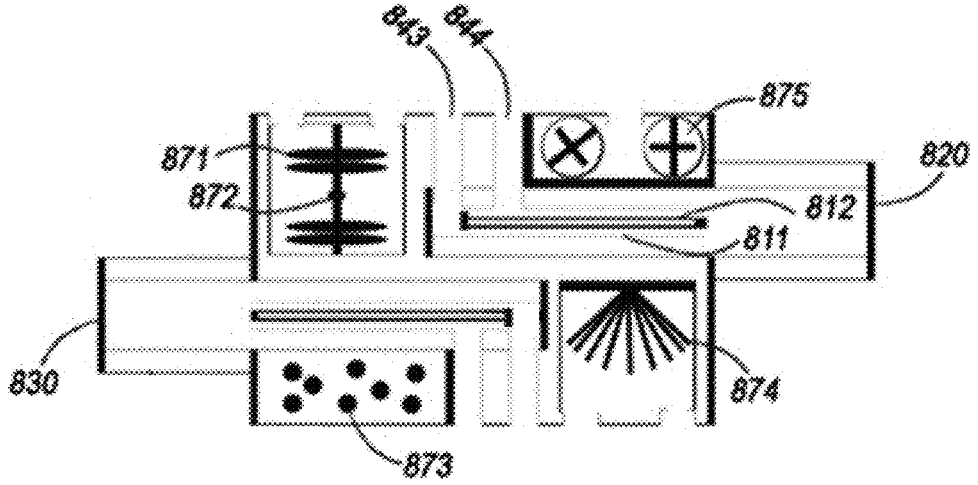
FIG. 20 illustrates an exploded view of FIG. 19 embedded shakers, tambourines, bells, clackers, and harmonicas.

FIG. 20 illustrates an example of the present invention embedded two mouthpieces or teething devices 820 and 830, as well as instruments such as tambourines 871, bells 875, shakers 873, clackers 874, and harmonicas 811-812 within its structure. User can bite or chew on mouthpiece 820 and 830 while inhaling air through the device or exhaling air from the device. Inhaling or exhaling air through the device activates reeds 811 or 812 which in turn make a sound. Airflow holes 843 and 844 help generate the air needed for a user to activate the reeds while the mouth is on the mouthpiece or teething device. Shaking the device activates bells 875, shakers 873, jingles 871 and clackers 874. User can attached additional instruments to the device using magnetic clips 801 and non-magnetic latches or clips 802. User can bit or chew on instrument mouthpieces 820 and 830, using it as a teething device.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A pacifier or a teething device comprising of a mouth-guard having a body, said body having a front-surface, a back-surface, and a thickness, wherein said thickness makes an interior space; a mouth-piece having a proximal end to be placed in a mouth and a distal end connected to said front-surface of said mouth-guard; an instrument embedded in said interior space or being connected to said back-surface and/or said front-surface of said mouth-guard by an attachment mechanism; and a handle connected to said back-surface of said mouth-guard or connected to said instrument, wherein said instrument being a harmonica, wherein said harmonica being embedded in said interior space or being connected to said device by said attachment mechanism, said harmonica comprising of:

a. a secondary mouth-piece extended perpendicularly from said mouth-guard;
b. a plurality of airway channels adjacently horizontally or vertically embedded on said interior space of said mouth-guard;
c. said airway channel having an interior wall;
d. a plurality of reeds having a plurality of lengths connected to said interior wall; and whereby said reeds being vibrated to generate sound when a user blowing air through said secondary mouth-piece.

2. The pacifier or the teething device of claim 1, wherein said reeds is made of wood, plastic, and/or metal.

3. A pacifier or a teething device comprising of a mouth-guard having a body, said body having a front-surface, a back-surface, and a thickness, wherein said thickness makes an interior space; a mouth-piece having a proximal end to be placed in a mouth and a distal end connected to said front-surface of said mouth-guard; an instrument embedded in said interior space or being connected to said back-surface and/or said front-surface of said mouth-guard by an attachment mechanism; and a handle connected to said back-surface of said mouth-guard or connected to said instrument, wherein said instrument being a kazoo, wherein said kazoo being embedded in said interior space or being connected to said device by said attachment mechanism, said kazoo comprising:

a. a secondary mouth-piece extended perpendicularly from said mouth-guard having an airway channel;
b. said mouth-guard having a hollow air chamber to form a casing;
c. said airway channel being connected to said air chamber;
d. an protrusion extending out of one end of said casing;
e. said protrusion having an exhaust thereby allowing excess air from said casing to exit from said air chamber;
f. a circular opening designed on a top side of said casing; and
g. a membrane made of plastic or paper covering said circular opening.

4. A pacifier or a teething device comprising of a mouth-guard having a body, said body having a front-surface, a back-surface, and a thickness, wherein said thickness makes an interior space; a mouth-piece having a proximal end to be placed in a mouth and a distal end connected to said front-surface of said mouth-guard; an instrument embedded in said interior space or being connected to said back-surface and/or said front-surface of said mouth-guard by an attachment mechanism; and a handle connected to said back-surface of said mouth-guard or connected to said instrument, wherein said instrument being an ocarina, wherein said ocarina being embedded in said interior space or being connected to said device by said attachment mechanism, said ocarina comprising of:

a. a secondary mouth-piece extended perpendicularly from said mouth-guard;
b. said secondary mouth-piece having an airway channel;
c. said mouth-guard having a hollow air chamber;
d. said airway channel being connected to said hollow air chamber; and
e. a plurality of exit holes arranged linearly on bottom surface of said casing.

5. A pacifier or a teething device comprising of a mouth-guard having a body, said body having a front-surface, a back-surface, and a thickness, wherein said thickness makes an interior space; a mouth-piece having a proximal end to be placed in a mouth and a distal end connected to said front-surface of said mouth-guard; an instrument embedded in said interior space or being connected to said back-surface and/or said front-surface of said mouth-guard by an attachment mechanism; and a handle connected to said back-surface of said mouth-guard or connected to said instrument, wherein said instrument being a tambourine, wherein said tambourine being embedded in said interior space or being connected to said device by said attachment mechanism, said tambourine comprising of:

a. a cylindrical hollow body having a plurality of opening on its wall; and
b. a plurality of circular jingles attached to said opening of said wall by a plurality of rods.

6. The pacifier or the teething device of claim 5, wherein said jingles being made of a metal, a plastic or a wood.

7. A pacifier or a teething device comprising of a mouth-guard having a body, said body having a front-surface, a back-surface, and a thickness, wherein said thickness makes an interior space; a mouth-piece having a proximal end to be placed in a mouth and a distal end connected to said front-surface of said mouth-guard; an instrument embedded in said interior space or being connected to said back-surface and/or said front-surface of said mouth-guard by an attachment mechanism; and a handle connected to said back-surface of said mouth-guard or connected to said instrument, wherein said instrument being a plurality of clackers, wherein said clackers being embedded in said interior space or being connected to said device by said attachment mechanism, said clackers comprising of:

a. circular plates between said circular disc and said cylindrical casing;
b. a plurality of pins located at ends of said plates connecting said pins;
c. said plates being loosely mounted on said pins; and
d. a gap between said plates.

8. The pacifier or the teething device of any one of claims 1, 3, 4, 5, and 7, wherein said attachment means is selected from the groups consisting of a magnet, a screw mechanism, a Velcro mechanism, and an interlocking groove.

* * * * *